US005264335A

United States Patent [19]

Twist et al.

[11] Patent Number: 5,264,335

[45] Date of Patent: Nov. 23, 1993

[54] PHOTOGRAPHIC SILVER HALIDE RECORDING MATERIAL

[75] Inventors: Peter J. Twist, Lee Common; John R. Jarvis, Cheddington, both of Great Britain

[73] Assignee: Eastman Kodak Company, Rochester, N.Y.

[21] Appl. No.: 914,217

[22] Filed: Jul. 14, 1992

Related U.S. Application Data

[63] Continuation of Ser. No. 686,724, Apr. 17, 1991, abandoned, which is a continuation of Ser. No. 408,971, Sep. 18, 1989, abandoned.

[51] Int. Cl.[5] ..... G03C 1/08

[52] U.S. Cl. ..... 430/543; 430/598; 430/505; 430/509; 430/547; 430/955; 430/550; 430/551

[58] Field of Search ..... 430/598, 505, 509, 547, 430/543, 955, 550, 551

[56] References Cited

U.S. PATENT DOCUMENTS

| | | | |
|---|---|---|---|
| Re. 32,097 | 3/1986 | Silverman et al. | 430/598 |
| 3,253,924 | 5/1966 | Loria et al. | 430/553 |
| 4,444,865 | 4/1984 | Silverman et al. | 430/598 |
| 4,656,122 | 4/1987 | Sowinski et al. | 430/505 |
| 4,656,123 | 4/1987 | Mihayashi et al. | 430/543 |
| 4,994,358 | 2/1991 | Deguchi et al. | 430/598 |
| 5,213,942 | 5/1993 | Deguchi et al. | 430/598 |

OTHER PUBLICATIONS

Research Disclosure, vol. 176, Dec. 1978, Item 17643, Paragraph VII.

*Primary Examiner*—Charles L. Bowers, Jr.
*Assistant Examiner*—Thomas R. Neville
*Attorney, Agent, or Firm*—Arthur E. Kluegel

[57] ABSTRACT

A color photographic recording material is described which comprises a silver halide emulsion layer containing a coupler compound capable of releasing a development accelerator or fogging agent and which material also contains silver halide grains which are more developable than the grains in the silver halide emulsion layer.

13 Claims, 3 Drawing Sheets

PHOTOGRAPHIC SILVER HALIDE RECORDING MATERIAL

This is a continuation of application Ser. No. 686,724, filed Apr. 17, 1991, now abandoned, which is a continuation of application Ser. No. 408,971, filed Sep. 18, 1989, now abandoned.

The invention relates to photographic silver halide recording material and, in particular to such materials having increased photographic speed.

Couplers which release a development accelerator or fogging agent (DARCS) have been described. They are added to silver halide emulsions in order to achieve an increase in speed brought about by the increased image development cause by the imagewise release of the development accelerator. However, too much DARC will cause fogging and this limits the extent to which speed can be increased.

In U.S. Pat. No. 4,656,123 it is said that in color materials the migration of development accelerators released by DARCs in one color unit to another color unit causes development producing image dye of the wrong color. This leads to the undesirable effect of color mixing. The solution disclosed is the use, between dye image forming layers of a different color, of a non-developable silver halide layer which acts as a scavenger layer deactivating any unused developer accelerator.

The present invention relates to a silver halide recording material containing a DARC compound showing improved speed increase without undue fog formation.

This invention provides a color photographic recording material comprising a support bearing a photosensitive silver halide emulsion layer containing a coupler capable of releasing a development accelerator or fogging agent (DARC) on color development wherein the recording material has added thereto photosensitive silver halide grains which are more developable than the grains of said silver halide layer whereby the speed of the emulsion is increased without unduly increasing fog.

Figure 1:
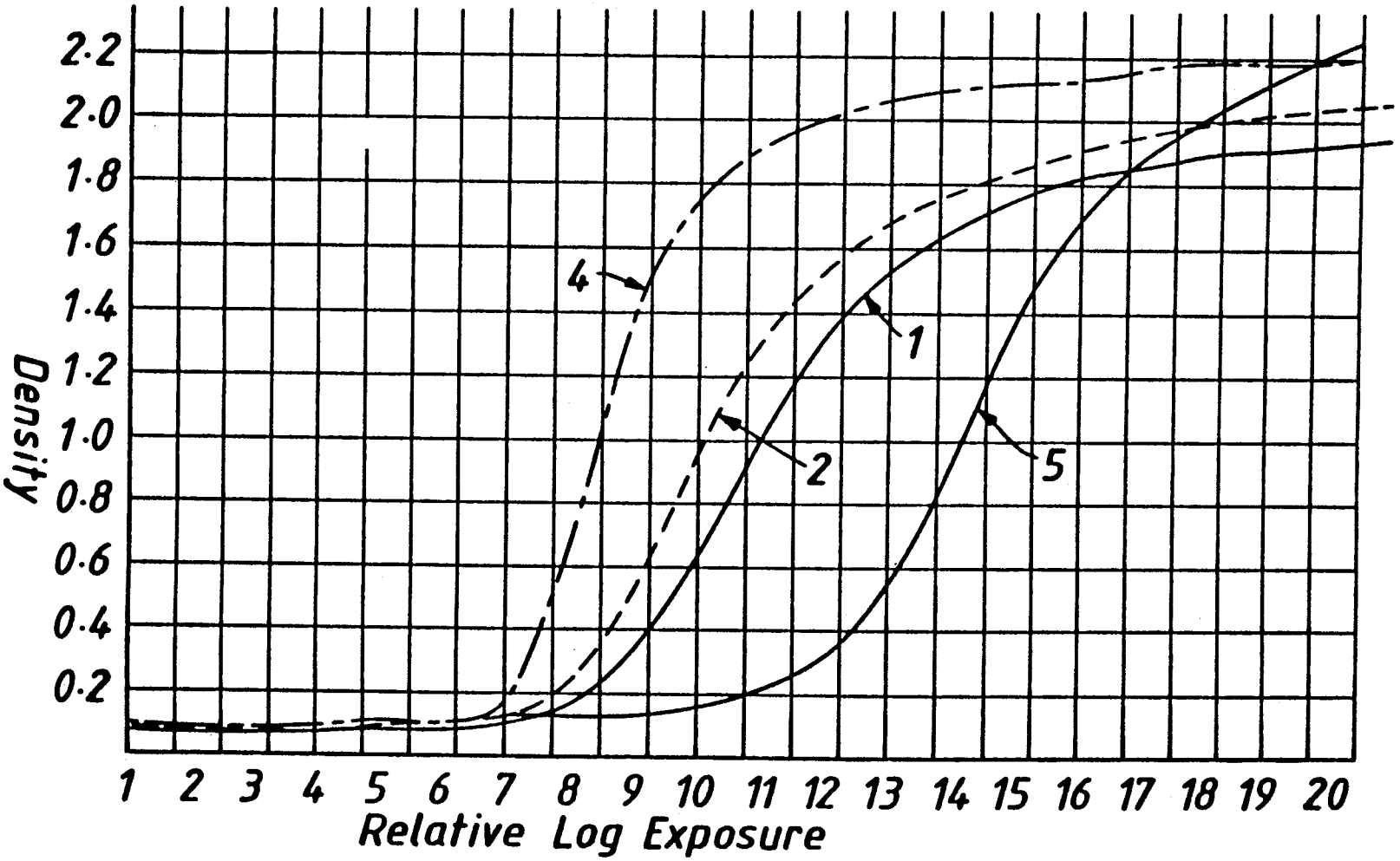
FIG. 1 is a graph which illustrates sensitometric response from coatings described in Example 1.

The recording materials of the present invention show higher photographic speeds and improved mid-scale granularity compared to materials without the added slow emulsion without undue increase in fog levels.

The DARC compound can be any of the types known in the art. These include the compounds described in U.S. Pat. Nos. 3,214,377; 4,390,618; 4,656,123; in Japanese published, unexamined application 17,437/76, or in U.K. published patent specification 2,097,140. This latter publication describes hydrazine moiety containing compounds having the formula:

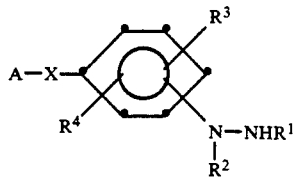

wherein:

A is a coupler residue;

X is a divalent linking group;

$R^1$ represents formyl, sulfonyl, alkoxycarbonyl, carbamoyl or a sulfamoyl group;

$R^2$ represents hydrogen, acetyl, ethoxycarbonyl or a methanesulfonyl group; and $R^3$ and $R^4$ represent hydrogen, an alkyl or alkoxy group having from 1 to 4 carbon atoms or a halogen atom.

As is well known, silver halide grains can be made more developable in a number of ways. The halide content is significant and the rate of development reduces as the halide changes, i.e. Cl>Br>I. Thus having silver chloride at the grain surface gives the highest rate of development. Another way to increase developability is to increase the surface area of the grains and this can be achieved by using smaller sized grains which, of course, will usually be of slower photographic speed.

A comparison of developability can be made by determining the time taken for comparable imagewise exposed coatings of different emulsions to reach a particular density in the same developer solution. For the emulsions employed in Example 2 below, the more developable silver chloride emulsion will develop to completion in 45 seconds while the less developable bromoiodide emulsion takes 2.5 minutes to only partially develop.

Preferably the more developable grains have a speed of at least 0.15, preferably at least 0.3, logE slower than that of the emulsion layer. The added grains are preferably of small size and high specific surface area. Preferably their size is from about 0.01 to about 1.0, especially from about 0.125 to about 0.15, of the mean grain size of the original emulsion lyaer.

The emulsion layer itself (before addition of the slower grains) may contain grains of a different size and indeed usually will. Its speed is to be taken as the speed of the emulsion when coated and tested. Typically a plot of the size distribution of grains in the original emulsion layer will show a single peak whereas after addition of the slower/smaller grains there will be two peaks.

As is usual, the term "size" in connection with grains means diameter if circular, or the diameter of a circle having the same area if not.

The granularity, although improved in the mid-scale, is increased in the toe region. Granularity can be improved by the inclusion of a DIR (developer inhibitor releasing) coupler or an anti-foggant.

The emulsion layer may also have, associated therewith, an image-dye providing coupler in addition to the DARC. Typically the element will have two or usually three emulsion layer units each sensitized to a different region of the visible spectrum.

The coupler compounds used in this invention are known compounds and can be prepared by techniques known in the art. The coupler combinations can be incorporated in silver halide emulsions and the emulsions can be coated on a support to form a photographic recording material. Alternatively, one or more couplers can be incorporated in photographic layers adjacent the silver halide emulsion where, during development, the coupler(s) will be in reactive association with development products such as oxidized color developing agent.

The photographic recording materials can be either single color or multicolor. In a multicolor material, the cyan dye-forming coupler is usually associated with a red-sensitive emulsion, the magenta dye-forming coupler is usually associated with a green sensitive emulsion and the yellow dye-forming coupler is usually associated with a blue sensitive emulsion, although they could be associated with unsensitized emulsions or with emulsions sensitized to a different region of the spectrum. Multicolor recording materials contain dye image-forming units sensitive to each of the three primary regions of the spectrum. Each unit can be comprised of a single emulsion layer or of multiple emulsion layers sensitive to a given region of the spectrum. The layers, including the layers of the image-forming units, can be arranged in various orders as known in the art.

A typical multicolor photographic recording material comprises a support bearing a cyan dye image-forming unit comprising at least one red-sensitive silver halide emulsion layer having associated therewith at least one cyan dye-forming coupler, a magenta image forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. The recording material can contain additional layers, such as filter layers, interlayers, overcoat layers, subbing layers, and the like.

As used herein, the term "associated with" signifies that the coupler is incorporated in the silver halide emulsion layer or in a layer adjacent thereto where, during processing, it is capable of reacting with silver halide development products.

Such multicolor materials contain dye image-forming units sensitive to each of the three primary regions of the spectrum. Each unit can be comprised of a single emulsion layer or of multiple emulsion layers sensitive to a given region of the spectrum.

The layers of the element, including the layers of the image-forming units, can be arranged in various orders as known in the art.

A typical multicolor photographic recording material comprises a support bearing yellow, magenta and cyan dye image-forming units comprising at least one blue-, green- or red-sensitive silver halide emulsion layer having associated therewith at least one yellow, magenta or cyan dye-forming coupler respectively. The element can contain additional layers, such as filter and barrier layers.

In the following discussion of suitable agents for use in the recording materials of this invention, reference will be made to Research Disclosure, December 1978, Item 17643, published by Industrial Opportunities Ltd., The Old Harbourmaster's, 8 North Street, Emsworth, Hants P010 7DD, U.K. This publication will be identified hereafter as "Research Disclosure".

The silver halide emulsion employed in the recording materials of this invention can be either negative-working or positive-working. They may contain grains of any shape, e.g. cubic, octahedral or tubular or mixtures thereof. Suitable emulsions and their preparation are described in the literature, e.g., in Research Disclosure Sections I and II and the publications cited therein. Suitable vehicles for the emulsion layers and other layers of the recording materials of this invention are described in Research Disclosure Section IX and the publications cited therein.

The photographic recording materials of this invention or individual layers thereof, can contain brighteners (see Research Disclosure Section V), antifoggants and stabilizers (See Research Disclosure Section VI), antistain agents and image dye stabilizer (see Research Disclosure Section VII, paragraphs I and J), light absorbing and scattering materials (See Research Disclosure Section VIII), hardeners (see Research Disclosure XI), plasticizers and lubricants (see Research Disclosure Section XII), antistatic agents (see Research Disclosure Section XIII), matting agents (see Research Disclosure Section XVI) and development modifiers (see Research Disclosure Section XXI).

The photographic recording materials can be coated on a variety of supports as described in Research Disclosure Section XVII and the references described therein.

Photographic recording materials can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-3-methyl-N,N-diethylaniline hydrochloride, 4-amino-3-methyl-N-ethyl-N-β-(methanesulphonamido)ethylaniline sulphate hydrate, 4-amino-3-methyl-N-ethyl-N-β-hydroxyethylaniline sulphate, 4-amino-3-β-(methanesulphonamido)ethyl-N,N-diethylaniline hydrochloride and 4-amino-N-ethyl-N-(2-methoxyethyl)-m-toluidine di-p-toluene sulphante.

With negative-working silver halide emulsions this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The following Examples are given for a better understanding of the invention. All temperatures are in ° C.

EXAMPLE 1

A set of coatings of the structure described below was made with a range of blends of fast and slow emulsions in which the total silver coating weight was 1.0 g/m$^2$. All units are in g/m$^2$. A yellow image coupler of the formula:

Details of coatings are as follows:

| Coating Number | Fast Emulsion (as silver) | Slow Emulsion (as silver) | DARC |
|---|---|---|---|
| 1 | 1.0 | — | — |
| 2 | 1.0 | — | 0.05 |
| 3 | 0.75 | 0.25 | — |
| 4 | 0.75 | 0.25 | 0.05 |
| 5 | — | 1.0 | — |
| 6 | 0.75 | 0.25 | — |
| 7 | 0.75 | 0.25 | 0.10 |

was included and three levels of the DARC of the formula:

| | |
|---|---|
| Develop | 2.5 minutes |
| Fix | 2.0 minutes |
| Wash | 3.0 minutes |

in each emulsion combination. The fast emulsion was an IS0400 speed bromo-iodide (6% iodide) T-grain emulsion of 1.14 μm grain size and the slow was ISO 100 speed bromoiodide (4.8% iodide) three dimensional grain emulsion of 0.32 μm grain size. Both emulsions were chemically sensitized. All figures are coating weights in g/m$^2$.

Details of coatings are as follows:

| Coating Number | Fast Emulsion (as silver) | Slow Emulsion (as silver) | DARC |
|---|---|---|---|
| 10 | 1 | — | — |
| 11 | 1 | — | 0.02 |
| 12 | 0.88 | 0.12 | 0.02 |
| 13 | — | 1 | — |

All emulsion layers contained gelatin (2.2) and coupler (0.6) and had a supercoat of gelatin (1.0) above.

These coatings were processed in a cycle described below:

| | |
|---|---|
| develop | 2.5 min. |
| bleach | 4.5 min. |
| wash | 2.0 min. |
| fix | 3.0 min. |
| wash | 3.0 min. |

The developer and fixer were standard C-41 solutions at 37.8° C. The customary bleach bath was omitted in order to leave the silver image in place for diagnostic purposes. Exposures were made on a graduated 21-step test object with a 0.2 logE exposure increment for 0.01 seconds to simulated daylight. The sensitometric response curves showing dye+silver density are shown in FIG. 1. It can be seen that the DARC increases the speed of the fast emulsion by about 0.15 logE whereas with 25% of slow emulsion blended in the speed increase is about 0.3 logE with increased contrast. The slow emulsion by itself is approximately 0.8 logE slower than the fast emulsion. Further increases in speed (0.4 logE total) occur with 50% slow emulsion and 50% fast but now a noticeable fog increase (+0.1) occurs. Increase in DARC level to 0.1 g/m$^2$ gives a 0.4 logE speed increase for 25% slow with a 0.04 fog increase. Photomicrographs of the processed layers show a large number of fine grains of the slow emulsion contributing to the image in addition to the larger grains of the fast component. In the toe region of the characteristic curve there are more fine grains than large grains and this is responsible for the large speed increase associated with this phenomenon.

EXAMPLE 2

To illustrate the general nature of this phenomenon, a second set of coatings was made as described in Example I but now with a chemically sensitized silver chloride 0.44 μm cubic grain paper emulsion as slow component.

| Coating Number | Fast Emulsion (as silver) | Slow Emulsion (as silver) | DARC |
|---|---|---|---|
| 10 | 1 | — | — |
| 11 | 1 | — | 0.02 |
| 12 | 0.88 | 0.12 | 0.02 |
| 13 | — | 1 | — |

Figure 2:
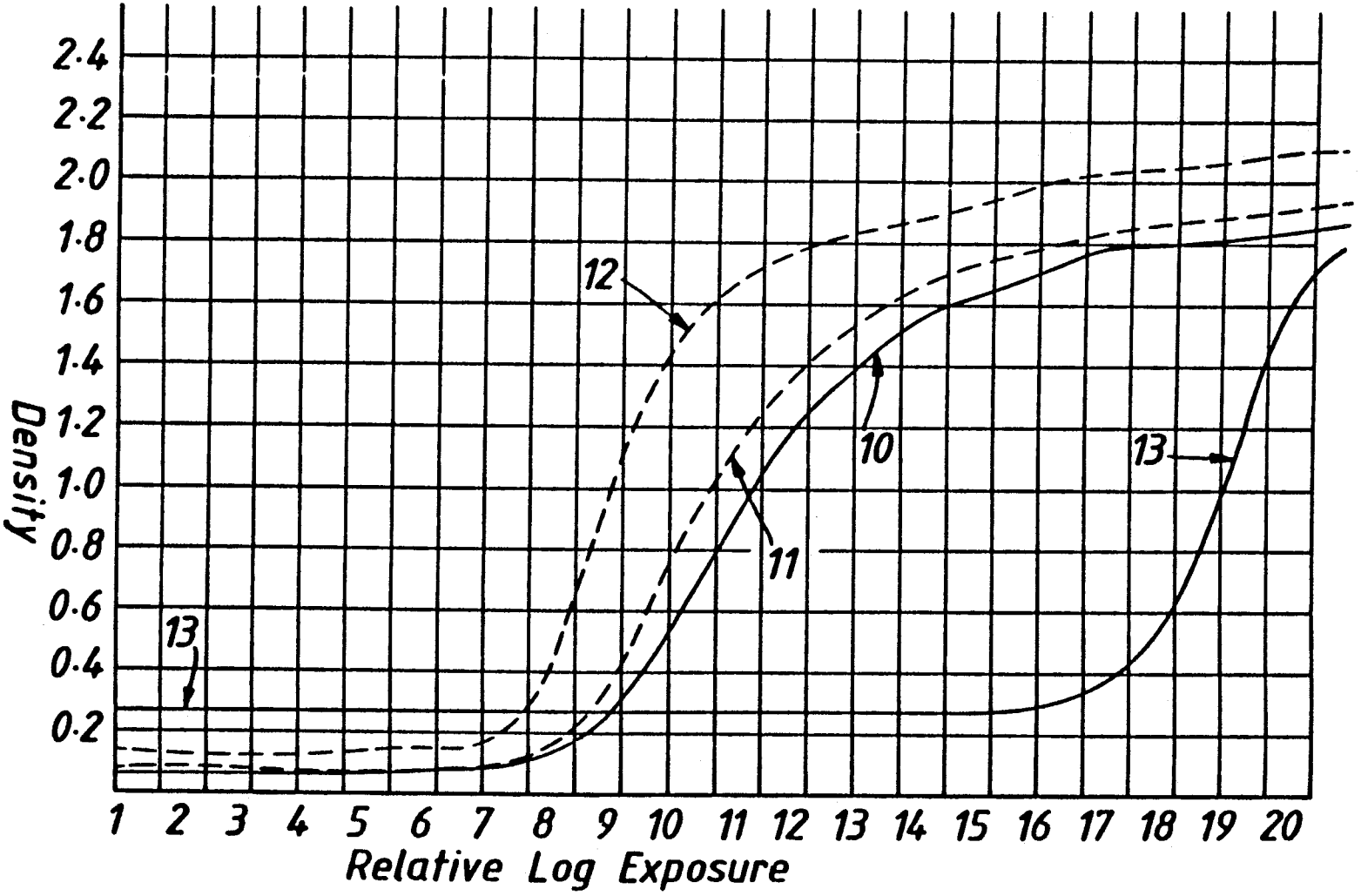
FIG. 2 is a graph which illustrates sensitometric response from coatings described in Example 2.

The result is shown in FIG. 2. Here a smaller level of DARC (0.02 g/m$^2$) and a 12% level of chloride emulsion give a 0.2 logE speed increase but with increased fog. This is because the chloride emulsion is overdeveloped in the processing cycle described above and is running into fog. Further experimentation with different processing cycles is likely to improve on this result.

EXAMPLE 3

Granularity Measurements

Further strips of coatings 1, 2 and 4 were exposed as in Example 1 and processed through the following cycle:

| | |
|---|---|
| develop | 2.5 min. |
| bleach | 4.5 min. |
| wash | 2.0 min. |
| fix | 3.0 min. |
| wash | 3.0 min. |

Figure 3:
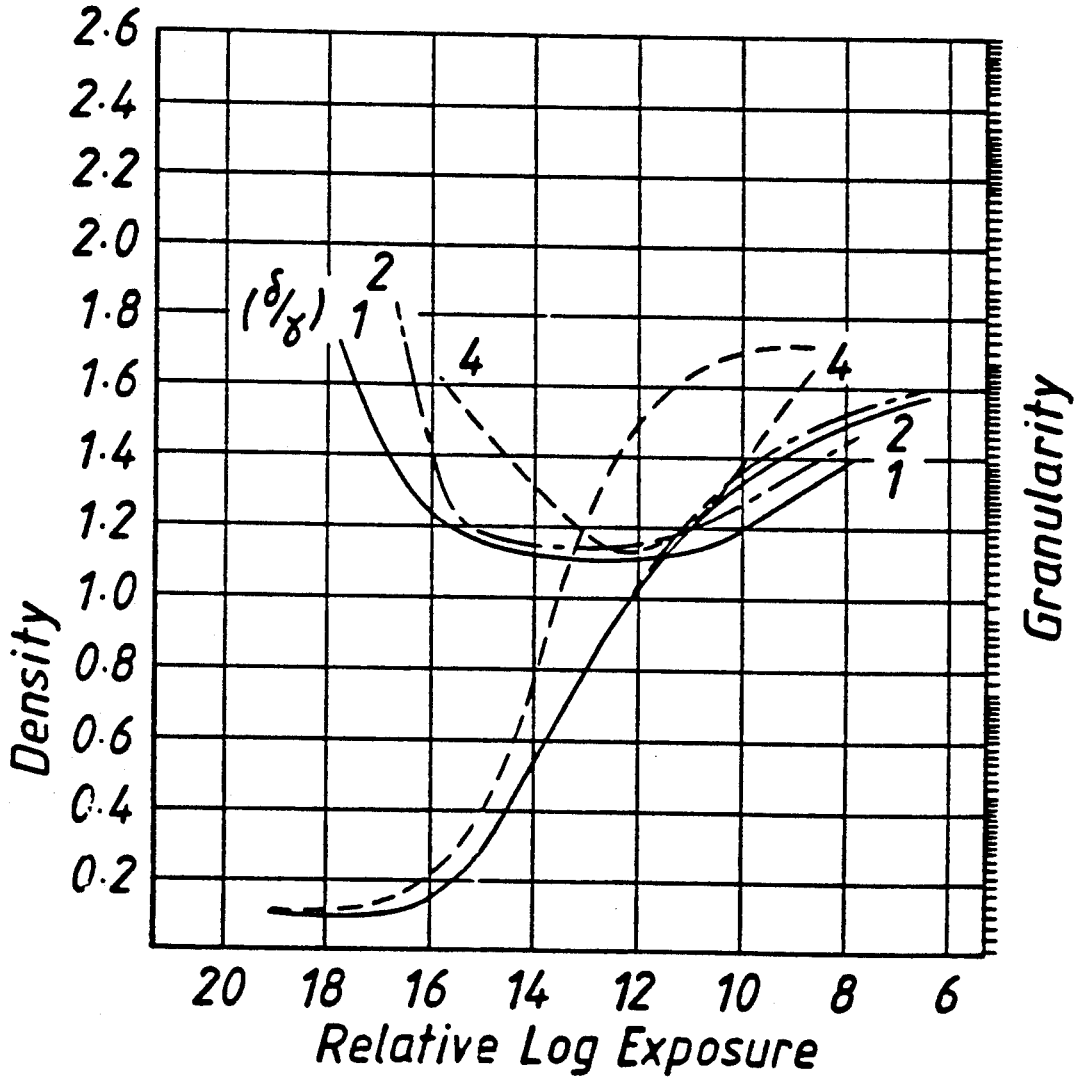
FIG. 3 is a graph which illustrates gamma normalized granularity measurements for several coating results from Example 1.

Gamma normalized granularity ($\sigma/\gamma$) measurements for coatings 1, 2 and 4 of Example 1 show that granularity curves have been shifted parallel to the relative exposure axis to that the speed points are superimposed. With this mode of analysis, a comparison of ($\sigma/\gamma$) values at a given relative exposure level in FIG. 3, will reflect relative differences in final print granularity. Although there is a substantial increase in toe ($\sigma/\gamma$) with (4) compared with the fast emulsion alone (1) this is to be expected since (1) is 0.3 logE slower (see FIG. 1). In the mid-scale, however the ($\sigma/\gamma$) response with (4) is comparable to (1). Thus mid-scale print granularity equivalent to that of a much slower coating (−0.3 logE) can be achieved by means of the present invention.

The invention has been described in detail with reference to preferred embodiments thereof but it will be understood that variations and modifications can be effected within the spirit and scope of the invention.

What is claimed is:

1. A color photographic recording material comprising a support bearing a photosensitive silver halide emulsion layer containing a coupler capable of releasing a development accelerator or fogging agent on color development wherein the recording material has added thereto photosensitive silver halide grains which are more developable than the grains of said silver halide emulsion layer whereby the speed of the emulsion is increased without unduly increasing fog.

2. The photographic recording material of claim 1 wherein the more developable grains have a speed of at least 0.15 logE slower than that of said emulsion layer.

3. The photographic recording material of claim 1 wherein the more developable grains have a speed of at least 0.3 logE slower than that of said emulsion layer.

4. The photographic recording material of claim 1 wherein the more developable grains have a size which is from about 0.01 to about 1.0 of the mean grain size of said emulsion layer.

5. The photographic recording material of claim 1 wherein the more developable grains have a size which is from about 0.125 to about 0.15 of the mean grain size of said emulsion layer.

6. The photographic recording material of claim 1 wherein the more developable grains comprise a higher portion of silver chloride and a lower portion of silver iodide than in the less developable grains.

7. The element of claim 1 wherein a plot of the grain sizes shows two or more peaks.

8. The element of claim 1 wherein the element is a negative working color element.

9. The element of claim 1 wherein the element contains up to 50% by weight of the total light sensitive silver halide grains of the more developable grains.

10. The element of claim 1 wherein the layer containing the development accelerator releasing coupler also contains a yellow dye-forming coupler.

11. The element of claim 1 wherein the more developable grains contain more chloride than the less developable grains.

12. The element of claim 1 wherein the more developable grains contain less iodide that the less developable grains.

13. A process for forming a color image comprising contacting an exposed element as described in claim 1 with a color developing agent.

* * * * *